United States Patent [19]

Peters

[11] 4,103,837

[45] Aug. 1, 1978

[54] LOOM CORE

[75] Inventor: Anthony J. Peters, Columbia, S.C.

[73] Assignee: Sonoco Products Company, Hartsville, S.C.

[21] Appl. No.: 814,687

[22] Filed: Jul. 11, 1977

[51] Int. Cl.[2] ..... B65H 75/30; B65H 75/10

[52] U.S. Cl. ..... 242/46.21; 242/118.3

[58] Field of Search ..... 242/68.5, 118.3, 118.32, 242/46.2, 46.21, 118.31, 46.3, 118.4, 118.7, 118.1

[56] References Cited

U.S. PATENT DOCUMENTS

| | | | |
|---|---|---|---|
| 1,975,363 | 10/1934 | Hornbuckle, Jr. | 242/46.21 |
| 2,535,188 | 12/1950 | Beckner | 242/118.32 |
| 2,585,999 | 2/1952 | Bunch | 242/46.21 |
| 2,615,650 | 10/1952 | Betner | 242/118.32 |
| 2,875,961 | 3/1959 | Mori et al. | 242/118.32 |
| 3,643,888 | 2/1972 | Blue | 242/118.32 |
| 3,958,776 | 5/1976 | Torzo | 242/118.32 |

*Primary Examiner*—George F. Mautz

*Attorney, Agent, or Firm*—Dennison, Dennison, Meserole & Pollack

[57] ABSTRACT

A core adapted to mount on and lock to the take-up spindle of a loom or textile weaving machine, the core having an elongated hollow configuration defined by a cylindrical wall. Aligned inwardly directed depressions at the opposed end portions of the core form inwardly directed keying protrusions which engage within an elongated keyway defined within the spindle. The protrusions are formed by mounting mandrels within the opposed ends of the core, heating the core end portions and deforming the heated end portions by means of pressure applying shoes and opposed complementary depressions within the mandrels.

8 Claims, 9 Drawing Figures

LOOM CORE

The present invention is generally concerned with cores or tubes upon which textile fabrics are wound. More particularly, the invention herein is directed to cores of the type which mount on the take-up spindle of a loom or weaving machine for the reception of the woven cloth thereabout.

Heretofor, difficulties have been encountered in providing cores which not only provide a smooth stable central shaft for fabric packages, but also can effectively although removably lock to the take-up spindle of a loom or weaving machine.

The present invention proposes the construction of a core of an appropriate thermoplastic polymer, such as acrylonitrile-butadiene-styrene (ABS), which includes a cylindrical wall having a cylindrical outer face with no external projections and only two longitudinally aligned depressions. These depressions form internal keys which engage within a full length keyway provided in the take-up spindle or mandrel for a keying of the core thereto. In this manner relative rotation between the core and the spindle is precluded, while at the same time allowing for an easy longitudinal sliding of the core relative to the spindle both when mounting the empty core and removing the wound core. The depressions and internal keys will be formed either extending inwardly from the extreme ends of the core or spaced inwardly approximately three inches from the core ends. Formation of the depressions and internal keys will normally be effected by appropriate pressure-applying shoes subsequent to a heating of the corresponding portions of the core. The internal protrusions formed will, in each instance, have both the inner and outer or leading and following ends thereof rounded or smoothly curved laterally outward toward the circumference of the core to facilitate a reception thereof in the spindle keyway, as well as a movement of the core along the keyway.

DESCRIPTION OF PREFERRED EMBODIMENT

Figure 1:
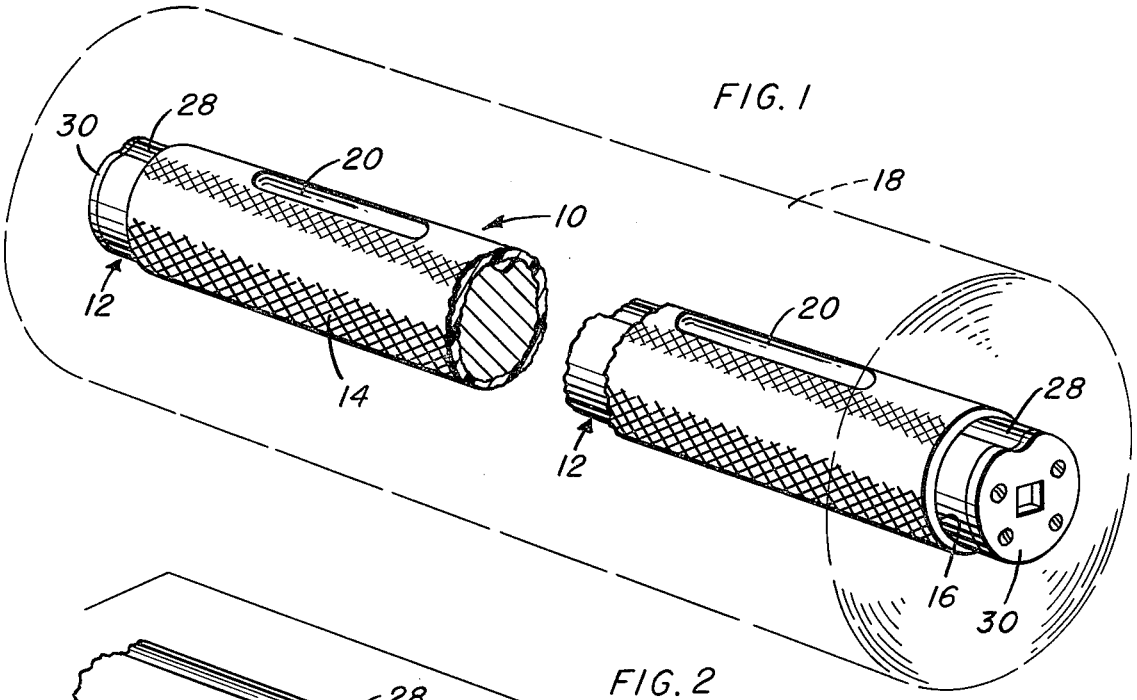
FIG. 1 is a perspective view of a spindle-mounted core with a phantom showing of textile fabric wound thereon.
Figure 2:
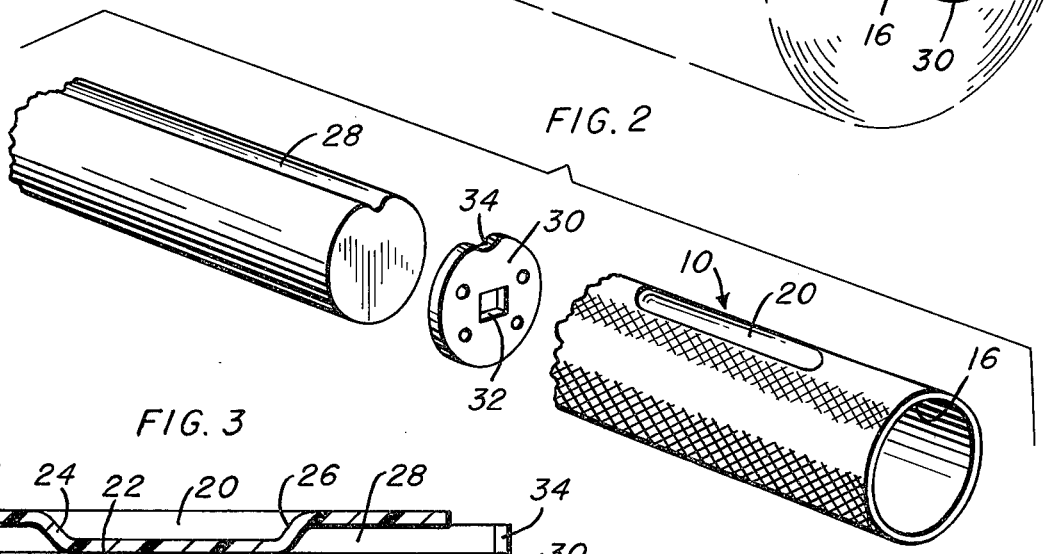
FIG. 2 is an exploded perspective view of the core, spindle and end cap.

Referring now more specifically to the drawings, reference numeral 10 is used to designate the textile core or tube of the present invention. This core 10 is of an elongated hollow configuration, generally conforming in length and diameter to the take-up spindle 12 of a loom or weaving machine for a longitudinal sliding mounting of the core on the spindle.

The core itself is defined by a rigid cylindrical wall 14 with opposed open ends 16. While not specifically limited thereto, it is proposed that the core be formed of an appropriate thermoplastic polymer, such as acrylonitrile-butadiene-styrene (ABS), with the strength of the core 10 being sufficient so as to support the textile fabric 18 in the finished textile package subsequent to the removal thereof from the loom spindle 12.

Figure 3:
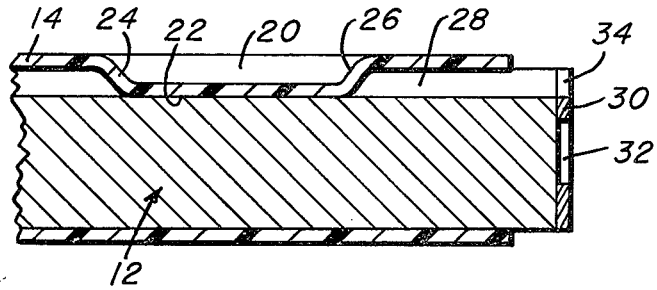
FIG. 3 is an enlarged cross-sectional detail through one end portion of the spindle-mounted core.

In order to effectively lock the core 10 to the rotatably driven spindle 12 for rotation therewith, the present invention proposes the formation of two longitudinally aligned depressions 20 within the cylindrical wall 14 with these depressions forming internal elongated protrusions or keys 22. As will be appreciated from FIGS. 1–4 of the drawings, each of the key forming depressions 20 is formed in inwardly spaced relation to the corresponding end 16 of the core wall 14. Further, noting FIG. 3 in particular, it will be seen that each protrusion or key 22 has the inner end 24 thereof rounded or curved so as to integrally meet with the cylindrical wall 14 laterally outward thereof. The opposite or outer end 26 of each key 22 is likewise laterally outwardly rounded or arcuately turned.

The inner surface of the core wall 14 will preferably be smooth for an easy sliding movement thereof onto and from the spindle 12. The external surface of the core wall 14 will, on the other hand, preferably be knurled or patterned over at least a major portion of the central part thereof so as to enhance the cooperation between the core and the textile fabric being wound thereon. It will be appreciated that the core 10 is devoid of external projections such as might interfere with the winding of the fabric thereon.

While not specifically limited thereto, it contemplated that the keys 22 be approximately 6 inches in length and inwardly spaced approximately three inches for the corresponding end of the core. The cores 12 themselves, depending upon the particular machinery used, will normally be approximately four to ten feet in length.

The spindle 12 will be formed of any durable, rigid material such as wood and will present a smooth cylindrical exterior interrupted only by a full length keyway 28 adapted to closely and slidable receive the core keys 22 in a manner whereby relative rotation between the core 10 and the spindle 12 is precluded.

Figure 8:
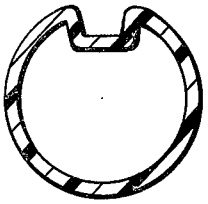
FIG. 8 is a transverse cross-sectional view through a core illustrating a variation in the cross-section of the depression and keying protrusion.

The rounded outer ends 26 of the elongated keys or protrusions 22 facilitate an engagement of the core with the spindle and insures a smooth sliding movement of the core over the spindle as the core is both mounted and removed. By the same token, the curved inner ends 24 of the keys 22 avoid any internal sharp angle projections such as might affect the mounting or removal of the core. It will also of course be appreciated that the keys 22 have a cross-sectional configuration which closely conforms to the cross-sectional configuration of the keyway 28 longitudinally along the exterior of the spindle 12. This cross-section, while normally arcuate as suggested in FIGS. 1 and 2, can be generally rectangular as seen in FIG. 8, depending on the cross-section of the keyway 28.

The spindle itself includes appropriate end caps 30 permanently mounted on the opposed ends thereof. These end caps incorporate appropriate drive means, for example drive sockets 32, for a driving of the spindle in the normal operation of the take-up apparatus of the loom or weaving machine. Further, as will be appreciated from the drawings, the end caps 30 include recesses 34 therein which conform to and continue the keyway 28.

Figure 4:
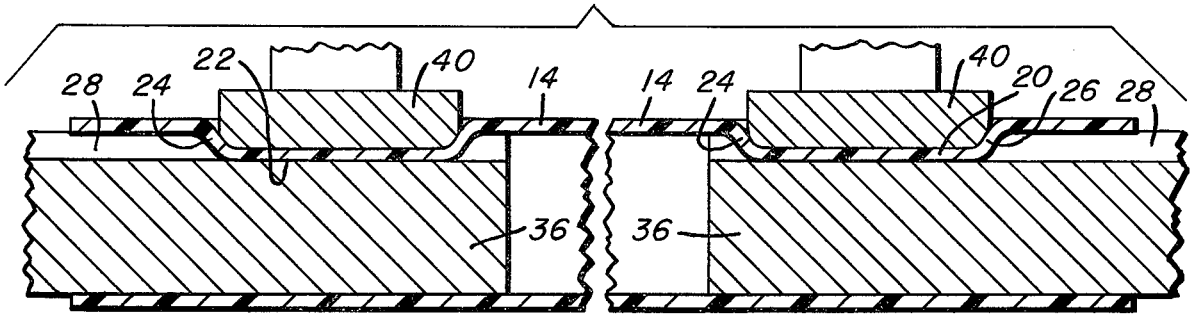
FIG. 4 is a schematic cross-sectional view illustrating the heat and pressure forming of the keying protrusion.
Figure 5:
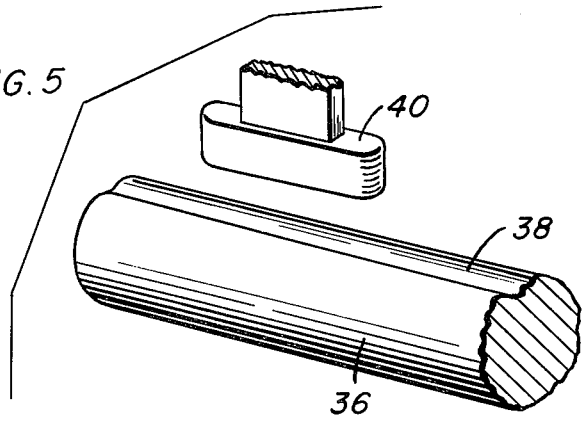
FIG. 5 is an exploded perspective view of a forming mandrel and a forming shoe.

Attention is now particularly directed to FIGS. 4 and 5 which schematically illustrate one manner of forming the two longitudinally aligned key forming depressions 20. Basically, a pair of short longitudinally aligned mandrels 36, each having a forming depression 38 therein, are introduced into the opposed ends of a core 10. These mandrels 36 will be adjustable so as to accommodate cores of different lengths and will be so interrelated to each other as to insure that the forming depressions therein are at all times longitudinally aligned. After a positioning of the mandrels 36, the core wall 14, in the areas wherein the depressions 20 are to be formed, is heated and softened, for example by the application of hot air. Upon a sufficient softening of the core wall, the hot air is removed and appropriate forming devices or shoes 40 depress the wall portions into the mandrel depressions 38. It will be appreciated that the configuration of each mandrel depression 38 and the corresponding forming shoe 40 are such so as to insure the desired rounded ends of the formed keys 22. The forming shoes 40 are then retracted and the formed core removed by a withdrawal of the mandrels from the opposed ends thereof.

Figure 6:
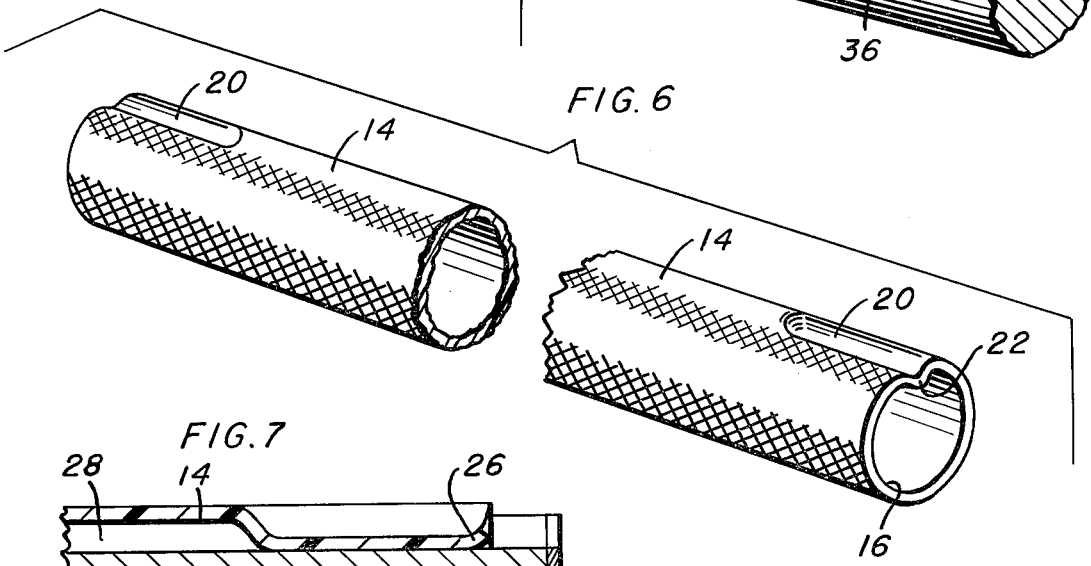
FIG. 6 is a perspective view of the end portions of the core illustrating a variation wherein the internal keying protrusion is formed extending inwardly from the end of the core.
Figure 7:
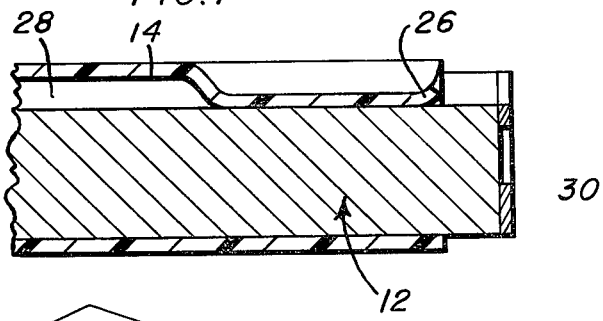
FIG. 7 is an enlarged cross-sectional detail through one end portion of the core of FIG. 6 mounted on a spindle.

With specific reference to FIGS. 6 and 7, attention is directed to a core construction wherein the two longitudinally aligned depressions 20, and the correspondingly formed internal elongated protrusions or keys 22, extend inwardly directly from the corresponding ends 16 of the core wall 14. In doing so, and as will be best seen in FIG. 7, the outer end 26 of each of these end positioned keys is retained with an outwardly curled or arcuately turned configuration so as to retain the advantages of being easily accommodated to the spindle keyway 28. The orienting of the depressions and protrusions at the extreme ends of the core, as illustrated in FIGS. 6 and 7, while not providing the structural interlocking stability of the preferred embodiment of FIGS. 1–4, is considered acceptable under certain operating conditions.

Figure 9:
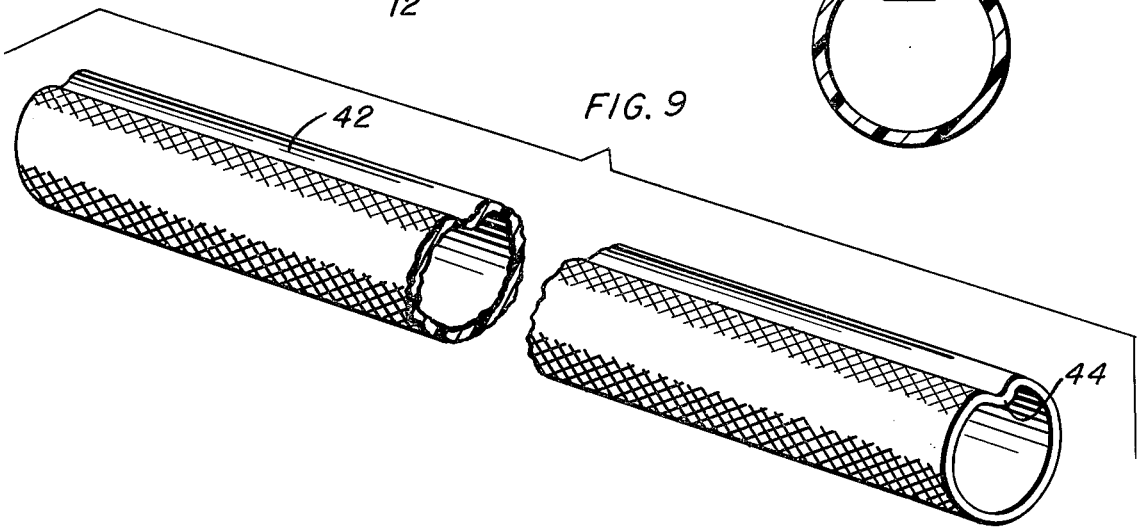
FIG. 9 is a perspective view of the core illustrating a variation wherein the internal keying protrusion extends the full length of the core.

Finally, attention is directed to FIG. 9 wherein the possibility of providing a full length depression 42 and corresponding internal protrusion 44 is set forth. In this embodiment, it will be appreciated that there will be an engagement with the spindle keyway along the full length of the core. Further, in this embodiment, it is also contemplated that the opposed ends of the depression of 42 be slightly outwardly rounded or curled for ease of accommodation to the spindle.

The foregoing is illustrative of the principles of the invention and further modifications and variations which may occur to those skilled in the art should be considered to fall within the scope of the invention as claimed.

I claim:

1. A textile fabric take-up spindle for a weaving machine and an associated core, said spindle having a cylindrical exterior with a single full length longitudinal groove formed therein, said core being of an elongated hollow configuration defined by a cylindrical wall with opposed open ends, said core being slidably receivable on said spindle, said cylindrical wall being interrupted solely by a plurality of longitudinally elongated and aligned depressions formed in the exterior thereof, said depressions defining a plurality of internal protrusions closely conforming to and receivable within the single spindle groove for a keying of the core to the spindle to preclude relative rotational movement therebetween.

2. The construction of claim 1 wherein said internal protrusions comprise a pair of longitudinally aligned internal protrusions, one adjacent each of the opposed ends of the cylindrical wall, for reception within the spindle groove.

3. The construction of claim 2 wherein each protrusion includes an inner end and an outer end, the outer end of each protrusion being laterally outwardly turned toward the exterior of the cylindrical wall for smooth movement within the spindle groove.

4. The construction of claim 3 wherein said spindle includes opposed ends, an end cap associated with each of said ends, each end cap incorporating spindle drive means, and each end cap having an edge recess formed therein which conforms to the spindle groove and constitutes an aligned continuation thereof.

5. The construction of claim 3 wherein each of the longitudinally aligned protrusions is provided in inwardly spaced relation to the corresponding open end of the cylindrical wall.

6. The construction of claim 3 wherein each inward deformation, and the protrusion formed thereby, extends inwardly from the corresponding open end of the cylindrical wall.

7. A textile fabric take-up spindle for a weaving machine and an associated core, said spindle having a cylindrical exterior with a single full length longitudinal groove formed therein, said core being of an elongated hollow configuration defined by a cylindrical wall with opposed open ends, said core being slidably receivable on said spindle, said cylindrical wall being interrupted solely along a single linear extent, corresponding to the single full length groove in the spindle, by at least one longitudinally elongated depression formed in the exterior of the cylindrical wall, said depression defining at least one internal protrusion closely conforming to and receivable within the single spindle groove for a keying of the core to the spindle to preclude relative rotational movement therebetween.

8. For use in the formation of a textile package in association with an elongated spindle having a single full length groove therein; a core having opposed end portions and open ends, said core being of an elongated hollow configuration defined by a cylindrical wall interrupted solely by a plurality of longitudinally extending and longitudinally aligned internal protrusions adapted to closely conform to and be received within a groove of a spindle having a single full length groove therein for a keying of the core to the spindle to preclude relative rotation therebetween, said protrusions being defined by an inward deformation of the cylindrical wall, and each protrusion including an inner end and an outer end, the outer end of each protrusion being laterally outwardly rounded toward the exterior of the cylindrical wall to facilitate engagement within and movement along a single spindle groove.

* * * * *